US009403612B2

(12) United States Patent
Carlson et al.

(10) Patent No.: US 9,403,612 B2
(45) Date of Patent: Aug. 2, 2016

(54) MANUALLY-ASSISTED VOID-FILL DUNNAGE DISPENSING SYSTEM AND METHOD

(75) Inventors: Daniel L. Carlson, Ravenna, OH (US); Timothy A. Frederick, Eastlake, OH (US)

(73) Assignee: Ranpak Corp., Concord Township, OH (US)

( * ) Notice: Subject to any disclaimer, the term of this patent is extended or adjusted under 35 U.S.C. 154(b) by 1392 days.

(21) Appl. No.: 12/867,363

(22) PCT Filed: Mar. 27, 2009

(86) PCT No.: PCT/US2009/038501

§ 371 (c)(1),
(2), (4) Date: Aug. 12, 2010

(87) PCT Pub. No.: WO2009/123919

PCT Pub. Date: Oct. 8, 2009

(65) Prior Publication Data

US 2010/0326021 A1 Dec. 30, 2010

Related U.S. Application Data

(60) Provisional application No. 61/040,942, filed on Mar. 31, 2008.

(51) Int. Cl.
*B65B 61/20* (2006.01)
*B65B 55/20* (2006.01)
(Continued)

(52) U.S. Cl.
CPC ..... *B65B 55/20* (2013.01); *B31D 5/0043* (2013.01); *B65B 61/207* (2013.01); *B65B 61/22* (2013.01); *B31D 2205/007* (2013.01); *B31D 2205/0035* (2013.01); *B31D 2205/0088* (2013.01)

(58) Field of Classification Search
CPC ..... B65B 61/20; B65B 61/22
USPC ..... 53/473, 396, 52, 503, 139.5, 64
See application file for complete search history.

(56) References Cited

U.S. PATENT DOCUMENTS 4,565,048 A * 1/1986 Lade ..... 53/201
4,922,687 A * 5/1990 Chow et al. ..... 53/472
(Continued)

FOREIGN PATENT DOCUMENTS

WO 98/56663 12/1998
WO 2006/017602 2/2006
WO 2007/121169 10/2007

OTHER PUBLICATIONS

International Search Report of corresponding International Application No. PCT/US2009/1038501, dated Jun. 24, 2009.
(Continued)

*Primary Examiner* — Brian D Nash
(74) *Attorney, Agent, or Firm* — Renner, Otto, Boisselle and Sklar, LLP

(57) ABSTRACT

A packaging system 100 includes a controller 102, an input device 104 in communication with the controller 102 that identifies one or more characteristics of the container, and a manual input device 106 in communication with the controller 102 that provides multiple input options for selection by a packer. The input options represent relative degrees to which a container is filled by one or more objects to be packaged. The controller 102 provides an output signal indicating a quantity of dunnage to dispense to the container based on the selected input option and the one or more identified characteristics of the container. Once the controller receives the container characteristics information, as well as the selected input option representing the relative degree to which the container is filled by the objects to be packaged, the controller can determine the number and lengths of dunnage strips that need to be provided to fill the remaining void in the container. Once the controller 102 has determined the amount dunnage that needs to be dispensed, the controller can signal a dunnage dispenser 110 to dispense the determined amount of dunnage.

22 Claims, 1 Drawing Sheet

(51) Int. Cl.
*B31D 5/00* (2006.01)
*B65B 61/22* (2006.01)

(56) References Cited

U.S. PATENT DOCUMENTS 5,105,600 A * 4/1992 DePoint et al. ..... 53/468
5,537,798 A * 7/1996 Fukuda et al. ..... 53/55
6,676,589 B2 1/2004 Kung et al.
6,877,297 B2 * 4/2005 Armington et al. ..... 53/502
2005/0050848 A1 3/2005 Harding
2007/0287623 A1 * 12/2007 Carlson et al. ..... 493/464
2008/0092488 A1 * 4/2008 Gabrielsen et al. ..... 53/428
2009/0173040 A1 * 7/2009 Carlson et al. ..... 53/250

OTHER PUBLICATIONS

International Preliminary Report on Patentability for corresponding International Application No. PCT/US2009/038501, dated Jun. 21, 2010.

* cited by examiner

MANUALLY-ASSISTED VOID-FILL DUNNAGE DISPENSING SYSTEM AND METHOD

This application is a national phase of International Application No. PCT/US2009/038501, filed Mar. 27, 2009, and published in the English language under Publication No. WO 2009/123919, which claims the benefit of U.S. Provisional Patent Application No. 61/040,942, filed Mar. 31, 2008, which are incorporated by reference.

FIELD OF THE INVENTION

The present invention is directed to a relatively inexpensive packaging system and method for dispensing an appropriate amount of void-fill dunnage to fill a void in a container.

BACKGROUND

In the process of packing one or more objects in a container for shipment, a void-fill dunnage product typically is placed in the shipping container along with the objects, partially or completely filling the empty space around the objects in the container to prevent or minimize shifting during the shipping process. Some commonly used void-fill dunnage materials include plastic foam peanuts, plastic bubble wrap, airbags, and converted paper dunnage. Some of these dunnage products take up a lot of space unless converted from a more compact stock material as needed.

Typically, a packer looks into a container in which one or more objects have been placed for shipment and determines the amount of dunnage material needed to fill the remaining void in the container. The packer then controls a dunnage dispenser to dispense the desired amount of dunnage. For strip-like dunnage products, an experienced packer can quickly determine how many and what lengths of dunnage strips are needed to fill the void in the container.

An inexperienced packer, however, has much more difficulty determining what lengths and what number of strips of dunnage are needed to fill the void volume. Consequently an inexperienced packer sometimes slows the packing process and is less efficient than an experienced packer. To avoid this problem, automated systems have been developed to measure the void volume in a container and then automatically determine the required dunnage strips for the packer. In some cases these systems remove the need for a packer altogether. The initial cost of a fully automated system generally is greater than that for a packer-operated system.

SUMMARY

The present invention provides an inexpensive solution to the inexperienced packer problem while providing appropriate lengths of void-fill dunnage for a wide variety of container sizes and product configurations.

An exemplary method according to the invention includes the step of manually selecting an input option from multiple input options. The input options represent relative degrees to which a container is filled by one or more objects to be packaged. The method also includes the steps of identifying one or more characteristics of a container, and providing an output signal indicating the quantity of dunnage to dispense to the container based on the selected input option and the one or more characteristics of the container.

Even an inexperienced packer can look at a container having one or more objects placed therein for shipping and select the input option that best represents the relative degree to which the container is filled. Once the characteristics of the container have been identified, and the packer has selected the best input option representing the relative degree to which the container is filled, a controller can determine the quantity of dunnage to dispense to fill the void in the container. Since void-fill dunnage typically has resilient properties that enable it to be slightly compressed without destroying its intended function, and since the void-fill dunnage does not need to fill the void absolutely completely, the packer's selected relative degree of fill typically is sufficient for the controller to determine an adequate amount of dunnage.

Accordingly, an exemplary void-fill packaging system includes a manual input device for selecting the input option representing the relative degree to which a container is filled by the one or more objects to be packaged, an input device that identifies one or more characteristics of the container, and a controller that provides an output signal indicating a quantity of dunnage to be dispensed to the container based on the selected input option and the one or more identified characteristics of the container.

The foregoing and other features of the invention are hereinafter fully described and particularly pointed out in the claims, the following description and the annexed drawings setting forth in detail several illustrative embodiments of the invention, such being indicative, however, of but a few of the various ways in which the principles of the invention may be employed.

DETAILED DESCRIPTION

The present invention provides an inexpensive solution to the problem of an inexperienced packer. Yet the present invention provides a system that can supply an appropriate length of void-fill dunnage for a wide variety of container sizes and product configurations. An inexperienced packer, even without knowing anything about the dunnage product being dispensed, can look at a container having one or more objects placed therein for shipping and can select the input option that best represents the relative degree to which the container is filled. Once the characteristics of the container have been identified, and the packer has selected the input option representing the relative degree to which the container is filled, a controller can determine the quantity of dunnage to dispense to fill the void in the container. This allows an inexperienced packer to effectively assist in determining the appropriate amount of dunnage to dispense, even when the packer has never performed the task before. Additionally, since void-fill dunnage typically has resilient properties that enable it to be slightly compressed without destroying its intended function, and since the void-fill dunnage does not need to fill the void absolutely completely to be effective, the packer's selected relative degree of fill typically is sufficient for the controller to determine an adequate amount of dunnage.

Briefly, the present invention provides a packaging system that includes means for manually selecting an input option from multiple input options, where the input options represent relative degrees to which a container is filled by one or more objects to be packaged, or means for manually inputting a relative degree to which a container is filled with one or more objects to be packaged. The packaging system also includes means for identifying one or more characteristics of the container, and means for providing an output signal indicating the quantity of dunnage to dispense to the container based on the selected input option and the one or more identified characteristics of the container. Alternatively, the system can include a means for outputting a signal indicating the quantity of dunnage to dispense based on the manually input relative degree of fill and the identified characteristics of the container.

Figure 1:
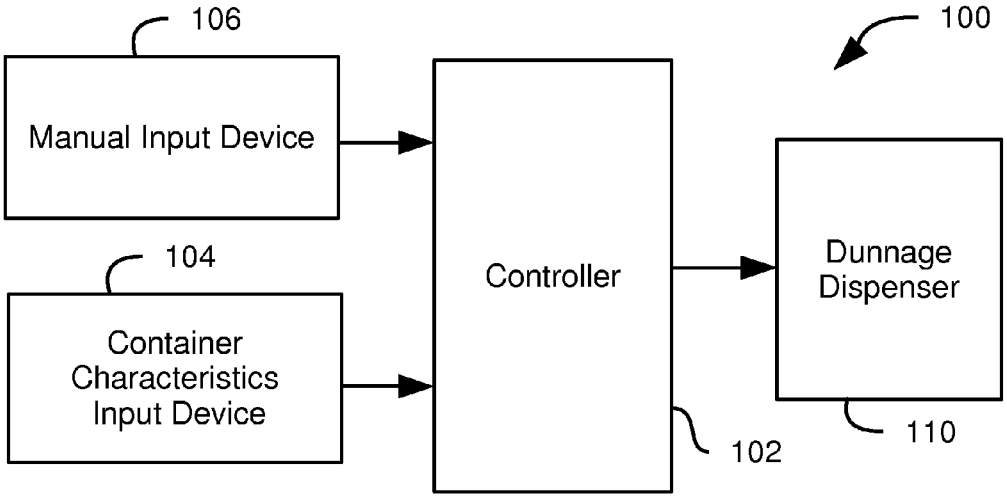
FIG. 1 is a schematic representation of a packaging system provided in accordance with the present invention.

Referring now to the drawings and initially to FIG. 1, the present invention provides a packaging system 100 that includes a controller 102, an input device 104 in communication with the controller 102 that identifies one or more characteristics of the container, and a manual input device 106 in communication with the controller 102 that provides multiple input options for selection by a packer. The input options represent relative degrees to which a container has been filled by one or more objects to be packaged. The relative degree of fill is an estimate or approximation of how full the container is, such as nearly empty, half full, and nearly full. The controller 102 provides an output signal indicating a quantity of dunnage to dispense to the container based on the selected input option and the one or more identified characteristics of the container.

The container characteristics can include one or more of a container identifier, a size, shape, and/or one or more dimensions of the container. The container identifier can include a barcode, name, number, color, radio frequency identification (RFID) or other indicia that can be used by the controller to identify the container and/or its unfilled or empty volume.

Once the controller 102 receives the container characteristics information, as well as the selected input option representing the relative degree to which the container is filled by the objects to be packaged, the controller 102 can determine the number and lengths of dunnage strips that need to be provided to fill the remaining void in the container. This can be accomplished in many ways. For example, once a container is identified, the controller 102 can calculate the void volume when the container is empty, and then using the approximate degree of fill provided by the packer, the controller 102 can calculate how much volume remains in the container that needs to be filled. If the approximate volume taken up by the dunnage is known, the controller 102 can calculate an amount of dunnage adequate to fill the void. Rather than calculating the void volume, the controller could look the information up in one or more look-up tables. For each container, for example container sizes A, B, and C, the look-up table may include the appropriate amount of dunnage to dispense depending on whether the container is nearly empty, half full, or nearly full.

Once the controller 102 has determined the amount of dunnage that needs to be dispensed, the controller can signal a dunnage dispenser 110 to dispense the determined amount of dunnage. The controller 102 can be integrated into the dunnage dispenser 110, or can be remotely located relative to the dunnage dispenser 110, and can either control the dispenser 110 remotely or communicate the amount of dunnage to be dispensed to another controller that is integrated into the dispenser 110.

Figure 2:
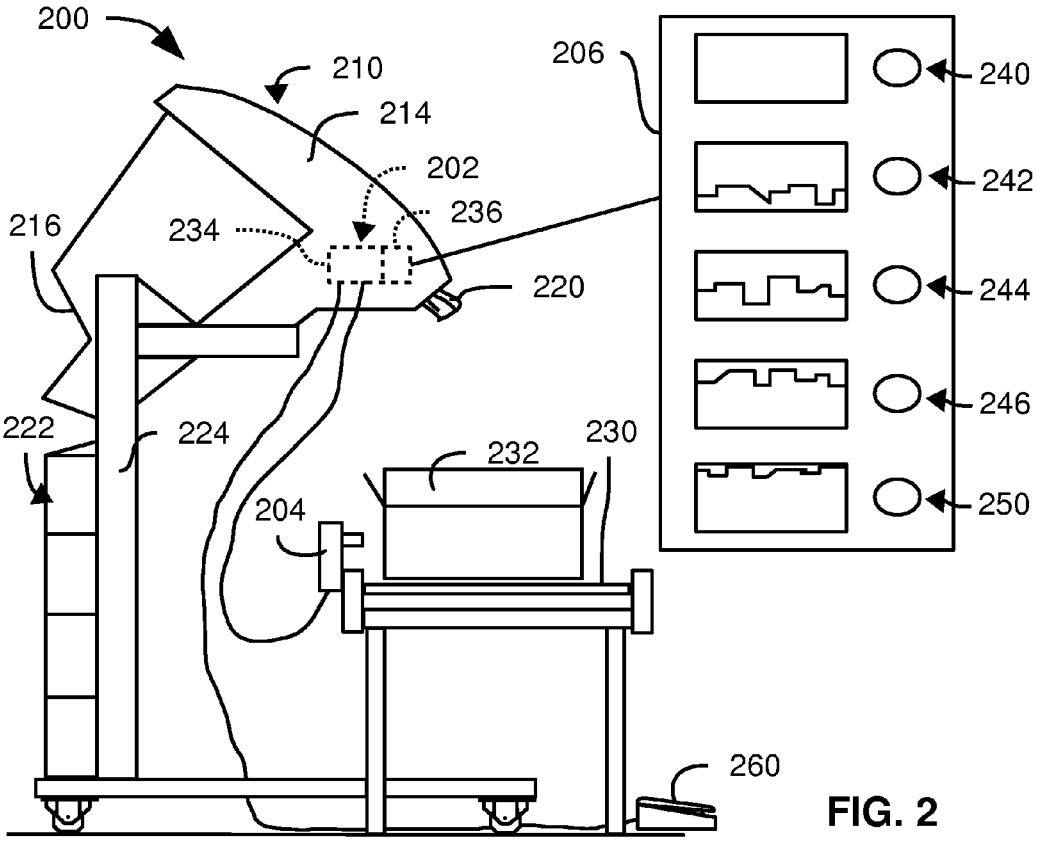
FIG. 2 is a schematic representation of an exemplary packaging system provided in accordance with the present invention.

An exemplary packaging system 200 provided in accordance with the present invention is illustrated in FIG. 2. The packaging system 200 includes a controller 202, a container characteristics input device 204, a manual input device 206, and a dunnage dispenser 210. An exemplary dunnage dispenser 210 is a void-fill dunnage conversion machine 214 that converts a sheet stock material 216 into a thicker and relatively less dense void-fill dunnage product 220, such as the conversion machine disclosed in U.S. Pat. No. 6,676,589, which is hereby incorporate herein by reference. An exemplary supply 222 of sheet stock material includes a stack of fan-folded kraft paper, such as that shown mounted on a stand 224 for the conversion machine 214, or a roll of one or more plies of sheet stock material.

The dunnage conversion 214 machine can be positioned adjacent a packaging surface, such as the illustrated conveyor 230, for dispensing packaging material to a container 232 on the packaging surface. An exemplary container 232 is a cardboard box, typically in the form of either a rectangular slotted container (RSC) with inwardly folding flaps, or a shoebox-style container with a separate lid. The controller 202 is integral to the dunnage conversion machine 214 and not only determines the amount of dunnage to dispense but also signals the conversion components of the machine to produce the determined amount of dunnage. The controller 202 includes a processor 234 and a memory 236 for storing programming and data needed to determine the amount of dunnage to dispense and to control the dunnage dispenser 210 or elements thereof to dispense the determined amount of dunnage, such as the number of and the lengths of dunnage strips, based on the container characteristics inputs and relative degree of fill inputs.

The container input device 204 includes at least one of a barcode reader, one or more sensors to indicate dimensions of the container 232, a mechanical, optical or electromagnetic probe, a computer mouse, a touch screen display, a keypad, a push-button switch, a toggle switch, a foot switch, a rotary dial, a kneepad switch, a wireless remote control device, a radio frequency identification (RFID) reader, and a stylus and stylus-sensitive pad or any other means for inputting container characteristics. As noted above, the container input device 204 identifies the container 232, the dimensions of the container, its size or other characteristics that will enable the controller 202 to determine the appropriate amount of dunnage to dispense. The container characteristics can be input in many different ways, either manually by a packer or automatically. One way to input the container characteristics includes reading a barcode, which the controller 202 will then look up in a look-up table to determine the amount of dunnage to dispense based on the barcode-identified container characteristics and the manually-selected degree-of-fill input option for that container. Alternatively, the controller 202 can calculate the void volume of an empty container and then determine how much of that void remains based on the selected manual input option provided by the packer.

The manual input device 206 can include one or more of a microphone, a computer mouse, a touch screen, a keypad, a rotary dial, a push-button, a switch, a foot switch, a kneepad switch, a wireless remote control device, a toggle slider, and a stylus and stylus-type sensitive pad or any other means for inputting a selected relative degree of fill for a container. The manual input device 206 provides input options between empty and full. Typically, the manual input device 206 provides about two to about five discrete input options. Some input devices, however, can provide an infinite number of options, limited only by the sensitivity of the input device. A slider, for example, can provide a continuum of options between empty and full and the operator can move the slider to the position that best represents the relative degree to which the container is filed. The same type of input can be provided via a touch screen. Alternatively, the input can be provided by the number of times a switch is triggered, or by triggering a particular switch among a plurality of switches provided.

Additionally, the manual input device 206 and the container characteristics input device 204 can be embodied in the same device. Accordingly, the packer could first read a box code into a microphone to identify the container and then select the relative degree of fill by speaking into the same microphone. The controller in that case can include voice recognition software to identify the words spoken and match them to known containers and degrees of fill. Such a system can be calibrated for different users, such as at the beginning of each shift, by having the packer recite the available options.

For discrete input options, exemplary input options include empty 240, 25% full 242, 50% full 244, 75% full 246, and full 250, which are shown in the illustrated embodiment as graphical representations with means for selecting the desired input option, such as a push-button switch or designated area of a touch screen. Alternatively, the input options may forego including empty and full as options, since an empty container and a full container probably will not require void-full dunnage. An empty container is likely to be an error or a fault condition that would require correction prior to dispensing dunnage thereto. A full container is a container that generally can be passed along for shipment without dispensing any void-full dunnage material thereto.

Another alternative set of input options can include nearly empty, half full, and nearly full. These are all relative degrees of fill that an experienced packer, or perhaps even a child, could identify by looking into a container without having any prior experience in providing dunnage material to a container for shipment. Additionally, as noted above, the manual input device 206 can include a linearly-variable level indicator with settings between empty and full, such as the slider mentioned above. The controller 202 then can use the selected manual input option and the container characteristics input to determine the amount of dunnage to dispense and instruct the conversion machine 214 to produce the determined amount of dunnage.

The dunnage conversion machine 214 or other dunnage dispenser can further include a dunnage dispensing input device 260, such as the illustrated foot switch, to manually dispense an additional amount of dunnage if the packer determines that the amount of dunnage determined by the controller 202 and dispensed from the dispenser 210 is insufficient to fill the void in the container 232. The manual dunnage dispensing input device 260 does not have to be a separate device, but can be the same device used as one or both of the manual input device 206 and the container characteristics input device 204.

An exemplary method provided in accordance with the present invention, includes the steps of (i) manually selecting an input option from multiple input options, where the input options represent relative degrees to which a container is filled by one or more products to be packaged, (ii) identifying one or more characteristics of a container, and (iii) providing an output signal indicating a quantity of dunnage to dispense to the container based on the selected input option and the one or more identified characteristics of the container. The selecting step can be performed manually by at least one of speaking into a microphone, pressing a button, moving a toggle switch or rotary dial, typing on a keypad, pressing a foot switch or a knee switch, touching a touch screen display, moving a slider switch, and clicking a computer mouse. Touching the touch screen display can include touching one or more areas of a touch screen display to select a discrete option or select from a linear range of options. The identifying step can include reading a bar code, reading a radio frequency identification tag (RFID tag), speaking into a microphone, sensing a dimension, pressing a button, moving a toggle switch or rotary dial, typing on a keypad, pressing a foot switch or a knee switch, and clicking a computer mouse.

The providing step includes transmitting the output signal to a dunnage dispenser or components thereof to dispense the indicated quantity of dunnage. Accordingly, the providing step can include transmitting the output signal to a dunnage conversion machine or components thereof to convert a stock material into a dunnage product to dispense the indicated quantity of dunnage.

The selecting step can include selecting from about two to about five discrete input options, or an input option from a range of linear continuous input options. The selecting step ca include selecting from discrete input options that include empty, 25% full, 50% full, 75% full, and full. Alternatively, the selecting step can include selecting from discrete input options that include nearly empty, half full, and nearly full. The method also can includes the step of manually dispensing an additional amount of dunnage.

As should be apparent from the description provided herein, the present invention provides a packaging system that an inexperienced packer can immediately operate and contribute to a company's packaging operation without requiring a lot of experience or training to do so effectively.

Although the invention has been shown and described with respect to a certain embodiment or embodiments, equivalent alterations and modifications will occur to others skilled in the art upon reading and understanding this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer that performs the specified function of the described integer (i.e., that is functionally equivalent), even though not structurally equivalent to the disclosed structure that performs the function in the herein illustrated exemplary embodiment of the invention.

What is claimed is:

1. A packaging system, comprising a manual input device that provides multiple input options for selection by a packer, the input options representing relative degrees to which a container is filled by one or more products to be packaged;

an input device that identifies one or more characteristics of a container; and a controller that provides an output signal indicating a quantity of dunnage to dispense to the container based on the selected input option and the one or more identified characteristics of the container.

2. A packaging system as set forth in claim 1, wherein the manual input device includes one or more of a microphone, computer mouse, a touch screen, a keypad, a push button, a switch, a foot switch, a kneepad switch, wireless remote control device, a slider, and a stylus and stylus-sensitive pad.

3. A packaging system as set forth in claim 1, wherein the manual input device provides about 2 to about 5 discrete input options.

4. A packaging system as set forth in claim 1, wherein the manual input device provides input options between empty and full.

5. A packaging system as set forth in claim 1, wherein the manual input device provides input options that include empty, 25% full, 50% full, 75% full, and full.

6. A packaging system as set forth in claim 1, wherein the manual input device provides input options that include nearly empty, half full, and nearly full.

7. A packaging system as set forth in claim 1, wherein the manual input device includes a linearly variable level indicator with settings between empty and full.

8. A packaging system as set forth in claim 1, wherein the container input device includes at least one of: a bar code reader; one or more sensors to indicate dimensions of a container; a mechanical, optical, or electromagnetic probe; a computer mouse; a touch screen display; a keypad; a push button; a switch; a foot switch; a kneepad switch; a wireless remote control device; a radio frequency identification tag reader; and a stylus and stylus-sensitive pad.

9. A packaging system as set forth in claim 1, comprising a dunnage dispenser in communication with the controller to dispense the indicated quantity of dunnage.

10. A packaging system as set forth in claim 9, wherein the dunnage dispenser includes a conversion machine that converts a stock material into a dunnage product.

11. A packaging system as set forth in claim 9, wherein the dunnage dispenser includes a dunnage dispensing input device to manually dispense an additional amount of dunnage.

12. A packaging method comprising the steps of:

manually selecting an input option from multiple input options, the input options representing relative degrees to which a container is filled by one or more products to be packaged;

identifying one or more characteristics of a container; and providing an output signal indicating a quantity of dunnage to dispense to the container based on the selected input option and the one or more identified characteristics of the container.

13. A packaging method as set forth in claim 12, wherein the selecting step is performed manually by at least one of speaking into a microphone, pressing a button, typing on a keypad, pressing a foot switch or a knee switch, touching a touch screen display, moving a slider switch, and clicking a computer mouse.

14. A packaging method as set forth in claim 12, wherein the identifying step includes reading a bar code, reading a radio frequency identification tag, speaking into a microphone, sensing a dimension, pressing a button, typing on a keypad, pressing a foot switch or a knee switch, and clicking a computer mouse.

15. A packaging method as set forth in claim 12, wherein the providing step includes transmitting the output signal to a dunnage dispenser to dispense the indicated quantity of dunnage.

16. A packaging method as set forth in claim 12, wherein the providing step includes transmitting the output signal to a dunnage conversion machine to convert a stock material into a dunnage product to dispense the indicated quantity of dunnage.

17. A packaging method as set forth in claim 12, wherein the selecting step includes selecting from about two to about five discrete input options.

18. A packaging method as set forth in claim 12, wherein the selecting step includes selecting from discrete input options that include empty, 25% full, 50% full, 75% full, and full.

19. A packaging method as set forth in claim 12, wherein the selecting step includes selecting from discrete input options that include nearly empty, half full, and nearly full.

20. A packaging method as set forth in claim 12, comprising the step of manually dispensing an additional amount of dunnage.

21. A packaging system comprising:

means for manually selecting an input option from multiple input options, the input options representing relative degrees to which a container is filled by one or more products to be packaged;

means for identifying one or more characteristics of a container; and means for providing an output signal indicating a quantity of dunnage to dispense to the container based on the selected input option and the one or more identified characteristics of the container.

22. A packaging system comprising means for manually inputting a relative degree to which a container is filled by one or more products to be packaged, means for identifying one or more characteristics of a container, and means for outputting a signal indicating the quantity of dunnage to dispense based on the manually input relative degree of fill and the identified characteristics of the container.

* * * * *